US010954678B2

(12) United States Patent
Monson et al.

(10) Patent No.: US 10,954,678 B2
(45) Date of Patent: Mar. 23, 2021

(54) HOLLOW WALL REPAIR APPARATUS, METHOD AND KIT

(71) Applicant: JMM Ingenuity, Salt Lake City, UT (US)

(72) Inventors: Benjamin Monson, Henderson, NV (US); Jeffrey S. Monson, Salt Lake City, UT (US); Michelle L. Monson, Las Vegas, NV (US)

(73) Assignee: JMM INGENUITY, Salt Lake City, UT (US)

( * ) Notice: Subject to any disclaimer, the term of this patent is extended or adjusted under 35 U.S.C. 154(b) by 0 days.

(21) Appl. No.: 16/574,612

(22) Filed: Sep. 18, 2019

(65) Prior Publication Data

US 2020/0087936 A1 Mar. 19, 2020

Related U.S. Application Data

(60) Provisional application No. 62/732,709, filed on Sep. 18, 2018.

(51) Int. Cl.
*E04G 23/02* (2006.01)

(52) U.S. Cl.
CPC ..... *E04G 23/0207* (2013.01)

(58) Field of Classification Search
CPC ..... E04G 23/0203; E04G 23/0207; E04G 15/066; E04G 23/0211
USPC ..... 52/514
See application file for complete search history.

(56) References Cited

U.S. PATENT DOCUMENTS

| | | | |
|---|---|---|---|
| 2,638,774 | A | 5/1953 | Wieman |
| 2,652,168 | A | 9/1953 | Nelson et al. |
| 3,441,242 | A | 4/1969 | Schonauer |
| 3,690,084 | A | 9/1972 | Leblanc |

(Continued)

FOREIGN PATENT DOCUMENTS

| | | |
|---|---|---|
| DE | 19917226 C1 | 8/2000 |
| JP | 2010121301 | 6/2010 |

(Continued)

OTHER PUBLICATIONS

Deziel, Chris; How to Patch Big Holes in Walls with Expanding Foam Source:https://www.hunker.com/13418463/how-to-patch-big-holes-in-walls-with-expanding-foam Date Accessed: Feb. 22, 2018.

(Continued)

*Primary Examiner* — Brian E Glessner
*Assistant Examiner* — Daniel J Kenny
(74) *Attorney, Agent, or Firm* — Workman Nydegger

(57) ABSTRACT

A method of repairing an opening in a wall includes positioning an unexpanded expandable apparatus within a cavity of a wall, aligning an anchor receiving cavity of the unexpanded expandable apparatus with the opening in the wall, and while maintaining the anchor receiving cavity in general alignment with the opening in the wall, expanding the unexpanded expandable apparatus. Following expanding the expandable apparatus, the method includes filling the anchor receiving cavity with an anchoring material, and covering the anchoring material and filling the opening with a filling material to repair the opening in the wall to allow a weight bearing fixture to be attached or reattached to the repaired area.

9 Claims, 9 Drawing Sheets

(56) References Cited

U.S. PATENT DOCUMENTS

| | | | | |
|---|---|---|---|---|
| 3,880,394 | A | 4/1975 | Wisecarver | |
| 3,936,988 | A | 2/1976 | Miceli | |
| 4,406,107 | A | 9/1983 | Schoonbeck | |
| 4,715,151 | A | 12/1987 | Garblik | |
| 4,848,056 | A | 7/1989 | Kelly | |
| 4,930,281 | A | 6/1990 | Martin et al. | |
| 4,945,700 | A | 8/1990 | Powell | |
| 5,033,949 | A | 7/1991 | Jewett | |
| 5,048,796 | A | 9/1991 | Maldonado | |
| 5,117,605 | A | 6/1992 | Waldbeiser | |
| 5,518,565 | A | 5/1996 | Castellucci et al. | |
| 5,555,691 | A | 9/1996 | Nguyen | |
| 6,994,809 | B1 | 2/2006 | Prior | |
| 7,121,054 | B2 | 10/2006 | Shock | |
| 9,624,664 | B2 | 4/2017 | Judd | |
| 2003/0079435 | A1 | 5/2003 | Lett et al. | |
| 2004/0135058 | A1 | 7/2004 | Wycech | |
| 2004/0221539 | A1* | 11/2004 | Rouail | E04F 19/026 52/716.1 |
| 2009/0025329 | A1* | 1/2009 | Morton | E04G 23/0203 52/514.5 |
| 2011/0167748 | A1 | 7/2011 | Joseph | |
| 2011/0239577 | A1* | 10/2011 | Hansen | E04G 23/0203 52/514 |
| 2011/0277412 | A1 | 11/2011 | Karam et al. | |
| 2011/0283645 | A1 | 11/2011 | Waters | |
| 2015/0040511 | A1 | 2/2015 | Potts et al. | |

FOREIGN PATENT DOCUMENTS

| | | |
|---|---|---|
| JP | 2012202047 | 10/2012 |
| JP | 2012219474 | 11/2012 |
| JP | 2013002220 | 1/2013 |
| JP | 2014101724 | 6/2014 |
| WO | WO 2012/079119 | 6/2012 |
| WO | WO 2015/089509 | 6/2015 |

OTHER PUBLICATIONS

RK Wall Repair; How to Fix a Wall With Rk Plasterplug Source: http://www.wallrepairguide.com/wallrepair/small-holes Date Accessed: Feb. 23, 2018.

* cited by examiner

HOLLOW WALL REPAIR APPARATUS, METHOD AND KIT

CROSS-REFERENCE TO RELATED APPLICATIONS

This application claims priority to and benefit of U.S. Provisional Patent Application No. 62/732,709, filed Sep. 18, 2018, the disclosure of which is incorporated herein by this reference.

BACKGROUND OF THE INVENTION

1. The Field of the Invention

The present invention generally relates to apparatus, methods, and kits for repairing holes formed in wall, and more particularly, relates to apparatus, methods, and kits for repairing holes formed in walls having a hollow-wall construction.

2. The Relevant Technology

Many constructed buildings use board or panel materials for walls and ceilings, such as drywall or wallboard, when forming hollow walls. While hollow walls provide adequate separation between rooms, and form lighter dividers than brick or other masonry walls, they are susceptible to damage, such as from door knobs or when previously mounted light fixtures, towel fixtures, toilet paper fixtures pictures, cabinets, hooks, mirrors, handrails or handles are deliberately or inadvertently detached or pulled out or off a wall. In many instances, the board or panel material can be repaired by cleaning the damaged area of debris, affixing a prefabricated patch to the panel material surrounding the damaged area, applying spackle or joint compound over the patch, and sanding, repeating application of the spackle or joint compound, and finally painting. However, prefabricated patches are unable to always accommodate for reattachment of weightbearing fixtures at the repaired location.

BRIEF SUMMARY OF THE INVENTION

Implementation of the present invention solves one or more problems in the art with kits, systems, methods, and apparatus for repairing holes formed in a wall panel, such as a wall panel associated with a hollow-form walls.

In particular, one configuration present invention relates to a method of repairing an opening in a wall that includes positioning an unexpanded expandable apparatus within a cavity of a wall, aligning an anchor receiving cavity of the unexpanded expandable apparatus with an opening in the wall, while maintaining the anchor receiving cavity in general alignment with at least a portion of the opening in the wall, expanding the unexpanded expandable apparatus, following expanding the expandable apparatus, filling the anchor receiving cavity with an anchoring material; and following curing of the anchoring material, covering the anchoring material and filling the opening with a filling material to repair the opening in the wall.

In another configuration, the present invention relates to expanding an expandable apparatus through a one-way valve until the expandable apparatus is secured within a cavity of a wall.

In another configuration, the present invention relates to sealing the one-way valve, the one-way valve being positioned at least flush with an outer surface of the expandable apparatus used to repair an opening in a wall.

In another configuration, the present invention relates to collapsing at least a portion of a valve body of a one-way valve to advance at least a portion of the valve body into an interior chamber of an expandable apparatus to position an end of the valve body flush or below a surface of a flexible body of an expandable apparatus used to repair an opening in a wall.

In another configuration, the present invention relates to maintaining an anchor receiving cavity in general alignment with at least a portion of an opening in a wall through disposing an elongate member within an anchor receiving cavity of the expandable apparatus to hold the expandable apparatus used to repair an opening in a wall.

In another configuration, the present invention relates to filling an anchor receiving cavity of an expandable apparatus through substantially completely filling the anchor receiving cavity with the anchoring material.

In another configuration, the present invention relates to covering an anchor material with a filling material, such as a spackle or joint compound.

One configuration of the present invention relates to an apparatus for repairing an opening in a wall, the apparatus including a flexible body having a front wall, a rear wall, a peripheral wall, and an interior wall, the peripheral wall comprising a circumferential ridge between a first peripheral wall portion and a second peripheral wall portion, the circumferential ridge controlling both radial and longitudinal expansion of the flexible body. An anchor receiving cavity extends through the flexible body along a central axis of the flexible body, a boundary of the anchor receiving cavity being defined by the interior wall and comprises a plurality of raised portions and troughs. A valve is mounted to the flexible body within at least a portion of the anchor receiving cavity.

In another configuration, the present invention relates to a flexible body of an expandable apparatus used to repair an opening in a wall, the flexible body being formed of a material selected from a synthetic rubber, a polymer, a fiber-reinforced polymer, or combinations thereof.

In another configuration, the present invention relates to an anchor receiving cavity of an expandable apparatus used to repair an opening in a wall, the anchor receiving cavity having a general hour-glass shape.

In another configuration, the present invention relates to an anchor receiving cavity of an expandable apparatus used to repair an opening in a wall, the anchor receiving cavity having a fluted configuration.

One configuration of the present invention relates to a kit for repairing an opening in a wall, the kit including an expandable apparatus including a flexible body with at least one chamber and a valve, the flexible body forming an internal chamber, an anchoring material configured to be disposed within the internal chamber, and a filler material configured to be disposed on the anchoring material and fill the opening to repair the opening in the wall.

In another configuration, the present invention relates to a kit for repairing a hole in a wall panel that includes a pump configured to selectively couple to a valve of an expandable apparatus positioned within a cavity of a wall.

In another configuration, the present invention relates to a kit for repairing a hole in a wall panel that includes a one-way valve as part of an expandable apparatus that can be positioned within a cavity of a wall.

In another configuration, the present invention relates to a kit for repairing a hole in a wall panel that includes a selective retractable valve as part of an expandable apparatus that can be positioned within a cavity of a wall.

In another configuration, the present invention relates to a kit for repairing a hole in a wall panel that includes a selectively collapsible valve as part of an expandable apparatus that can be positioned within a cavity of a wall, the valve becoming recessed or flush with a surface of a flexible body of the expandable apparatus.

In another configuration, the present invention relates to a kit for repairing a hole in a wall panel that includes a valve including a valve stem mounted to a flexible body of an expandable apparatus that can be positioned within a cavity of a wall, a flexible junction between the valve stem and the flexible body being configured to allow the valve stem to extend outwardly from a surface of the flexible body during filling of the expandable apparatus and collapsible to become flush with the surface of the flexible body following filling.

In another configuration, the present invention relates to a kit for repairing a hole in a wall panel that includes a one-part or multi-part epoxy for an anchor material.

In another configuration, the present invention relates to a kit for repairing a hole in a wall panel that includes a filler material of a gypsum and water mixture.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims or may be learned by the practice of such exemplary implementations as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
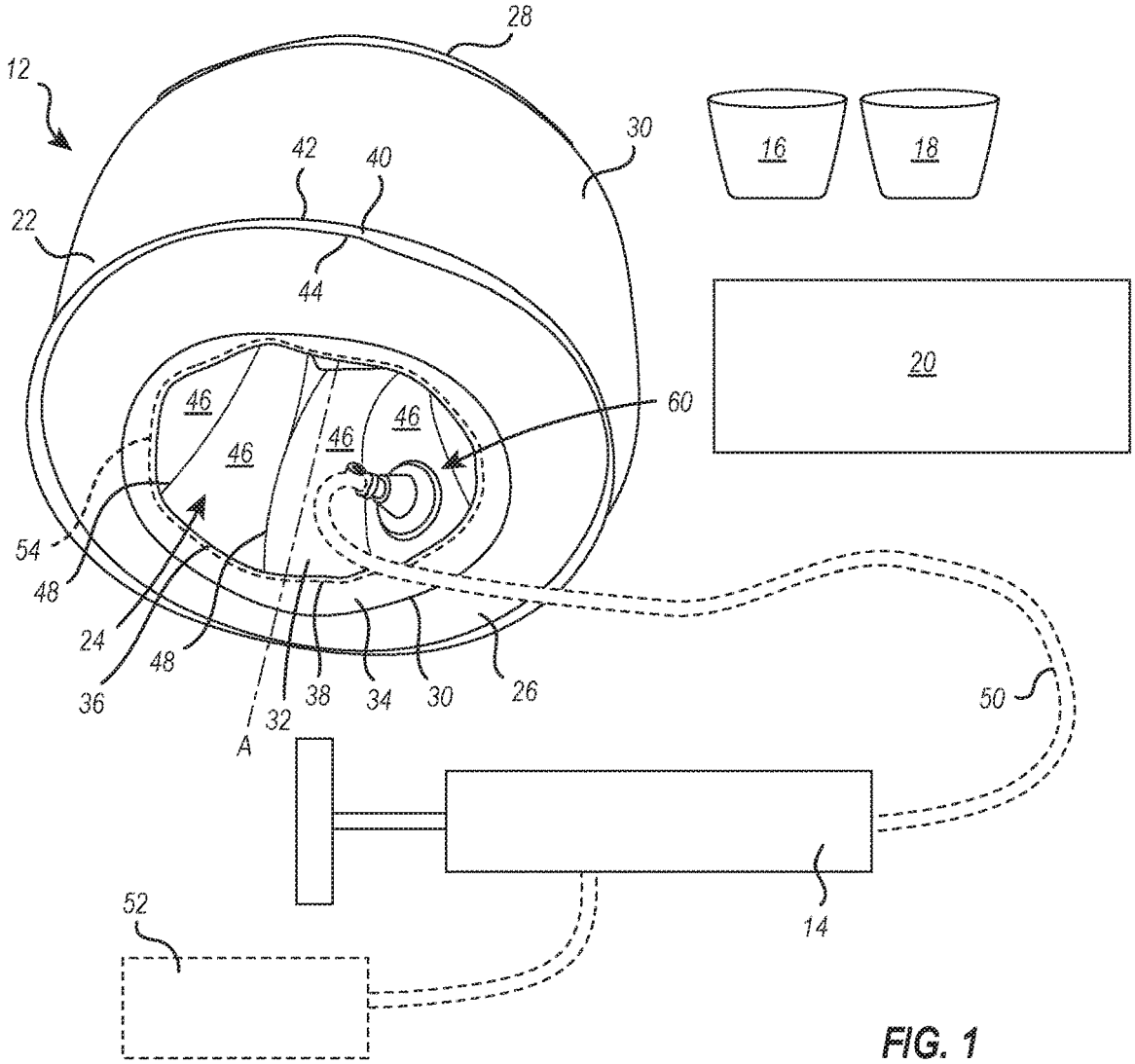
FIG. 1 illustrates an expandable apparatus and pump of a hole repair system according to one embodiment of the present invention.

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to apparatus, methods, and kits for repairing a hole or opening in a wall, where such wall can include walls, ceilings, floors, decks and roofs. The apparatus, methods, and kits are used to repair holes in a hollow wall construction, such as that use drywall, lath and plaster, wallboard, or otherwise have an open cavity between adjacent surfaces of the wall. The apparatus, methods, and kits use an expandable apparatus permitting the application of an anchor material or cavity filler that provides a repair suitable for installation of load-bearing fixtures, while also allowing for a highly cosmetic finish.

While the present disclosure will describe particular implementations of apparatus, methods, and kits for repairing a hole or opening in a wall, it should be understood that the apparatus, methods, and kits described herein may be applicable to other uses. Additionally, elements described in relation to any embodiments depicted and/or described herein may be combinable with elements described in relation to any other embodiment depicted and/or described herein.

Generally, now referring to the drawings in detail wherein like reference numerals are used to designate like elements, there is shown one or more embodiments of the present disclosure that provides methods, systems, apparatus, and kits for the repair of holes in a hollow wall construction, such as with drywall, lath and plaster, wallboard, or other panel-type material. The methods, systems, apparatus, and kits permit the application of an anchor material that provides a repair suitable for subsequent installation of load-bearing fixtures, while also providing a surface upon which a final filler material can be applied, such that a cosmetic finish can be formed at the repair location. While reference is made use on a wall, it will be understood more generally that the present disclosure can also be used on any surface, including, but not limited to, walls, ceilings, floors, decks and roofs, but shall not be restricted to flat planar surfaces.

Turning to FIG. 1, illustrated is a hole repair system 10 according to one configuration of the present invention. The hole repair system or kit 10 include one or more of an expandable apparatus 12, a pump 14 that connects to the expandable apparatus 12 to fill the expandable apparatus 12 with air or a fluid, an anchor material 16 that can be disposed within a cavity of the expandable apparatus 12 when the expandable apparatus 12 is in an expanded state within a cavity of a wall, and a filler material 18 that can cover the dried, set, or cured anchor material 16 to finish the repair in preparation for painting or other cosmetic treatment. The system or kit 10 can include all or less than all of the expandable apparatus 12, the pump 14, the anchor material 16, and the filler material 18 in a package 20, such as a container, hard-shell plastic container, shrink-wrap packaging, or modification, or combination of the same. In one particular kit, the expandable apparatus, the anchor material, and the filler material form the kit. In another kit, the expandable apparatus and the anchor material form the kit. In still another kit, only the expandable anchor forms the kit. The kit can optionally include reusable or one-time use gloves, a filler material knife, a tether or retrieval string (as will be described hereinafter) and other tools and supplies.

The expandable apparatus 12, such as an expandable bladder, bag, or other expandable structure, is illustrated as being fully or at least partially expanded or inflated in the view in FIG. 1. It is noted, however, that during use of the expandable apparatus 12 as illustrated in FIGS. 3-8, the expandable apparatus 12 is in an collapsed state during positioning through a hole 102 in a wall 100 (FIG. 4) and then expanded or inflated within a cavity 110 of the wall 100 using the pump 14 to secure the expandable apparatus 12 within the cavity 110 so that it functions as an anchor and guide to the anchor material 16 deposited in an interior cavity or anchor receiving cavity 24 of the expandable apparatus 12. Such expansion can be achieved through filling with air from the pump 14, through the conduit 50, to the expandable apparatus 12, but it will be understood that the discussion presented herein also applies to expanding the expandable apparatus 12 using another gas or fluid other than air. For instance, although the pump 14 can deliver air to the expandable apparatus 12 via the conduit 50, alternatively, the pump 14 can deliver a self-curing or curable fluid from a separate reservoir 52 through the conduit 50 and into the expandable apparatus 12. The self-curing or curable fluid can then set or cure or be set or cured following expanding the expandable apparatus 12 to be securely retained within the cavity of the hollow wall. Having a set or cured fluid within the expandable apparatus 12 provides another anchor point or location for installation of load-bearing fixtures. The self-curing or curable fluid can chemically cure or cure based upon application of heat, ultraviolet light, or other electromagnetic radiation to the fluid. For instance, the self-curing or curable fluid can be a structural polyurethane foam, thermoset plastic, polyester, or modifications or combinations thereof.

When air is delivered to the expandable apparatus 12, the pump 14 can inflate the expandable apparatus 12 with air to a sufficient pressure that the expandable apparatus 12 remains positioned within the cavity 110 (FIG. 4) of the wall 100 without moving. That pressure can be based upon the location of the device and the size of the cavity 110 (FIG. 4) receiving the expandable apparatus 12. For instance, the pressure could be varied if the expandable apparatus 12 is beside a stud 108. While the pump 14 is illustrated as a hand-held air pump, it will be understood that other hand-held or mechanically or electrically operated pumps can be used to direct air or other fluid along the conduit 50 to the expandable apparatus 12. For instance, other air pumps, positive displacement pumps, centrifugal pumps, compressors, vacuum pumps, bellows, or other structures that can direct air along the conduit 50 to the expandable apparatus 12 are possible. The amount to which the apparatus is inflated can vary and may depend on placement, cavity depth, hole size, or the like or combination thereof.

As illustrated in FIG. 1, the expandable apparatus 12 has a flexible body 22 with a generally ring-like form, in an expanded state, as viewed along an axis A of the expandable apparatus 12 extending through the anchor receiving cavity 24. The flexible body 22 can be cylindrical or have a toroidal configuration with a square, polygonal, round, oval, elliptical, or a closed-curve cross-section. Specific dimensions of the flexible body 22 and/or the anchor receiving cavity 24 may be proportionally adjusted to enlarge or decrease the size of expandable apparatus 12, while maintaining a generally ring-like configuration.

The flexible body 22 includes a front wall 26 and a rear wall 28 with a peripheral wall 30 and an interior wall 32 extending circumferentially between the front wall 26 and the rear wall 28. A ring 34 is disposed between the front wall 26 and the peripheral wall 30 through seams or ridged regions 36 and 38, with a similar junction between the rear wall 28 and the peripheral wall 30. A ring 40 connects the front wall 26 and the interior wall 32 through seams or ridged regions 42 and 44 with a similar junction between the rear wall 28 and the peripheral wall 30 The combination of front and rear walls 26 and 28 and the rings 34 and 40 aid with expanding the flexible body 22 longitudinally along the axis A, while controlling radial expansion. The ridged regions 36, 38, 42, and 44 can also aid with controlling radial expansion. By controlling the radial expansion, retention of the flexible body 22 within the cavity 110 (FIGS. 3-5) of the wall (100) is enhanced.

The ridged regions 36, 38, 42, and 44 can be formed from multiple layers of material forming, respectively, the front wall 26, the rear wall 28, the peripheral wall 30, the interior wall 32, the ring 34, and the ring 40. For instance, the ridged region 36 can be formed by bonding, with or without the use of an adhesive, a portion of the front wall 26 to the ring 34 to both seal them together and form a structural element that aids with controlling both radial and longitudinal expansion of the expandable apparatus 12. While reference is made to the specific structure of the ridged region 36, it will be understood that the other ridged regions 38, 42, and 44 can have similar multilayer construction through bonding other portions of the flexible body 22, such as the peripheral wall 30, the interior wall 32, the ring 34, and the ring 40.

To further aid the ridged regions 36, 38, 42, and 44 and/or the rings 34 and 40 in controlling both radial and longitudinal expansion of the expandable apparatus 12, optionally a self-expanding or resilient insert 54 can be positioned at or near the ridged regions 36, 38, 42, and 44 to enhance structural support. The self-expanding or resilient insert 54 aids with expanding the expandable apparatus 12 but has sufficient elasticity so that it does not impede collapsing of the flexible body 22 when the expandable apparatus 12 is inserted through the hole 102 in the wall 100. The self-expanding or resilient insert 54 provides an outward bias force to provide an initial expansion to the expandable apparatus 12 that is completed when the expandable apparatus 12 is filled. The self-expanding or resilient insert 54 can include a wire, ring, or other structure fabricated from a metal, alloy, polymer, shape-memory polymer, a shape-memory alloy, or modifications or combinations thereof.

As illustrated in FIG. 1, a plurality of raised portions 46 and troughs 48 form the interior wall 32 of the anchor receiving cavity 24. Each raised portion 46 curves longitudinally between the front wall 26 and the rear wall 28 and laterally between adjacent troughs 48, which also curve longitudinally between the front wall 26 and the rear wall 28. This creates a generally hour-glass shaped cavity, which is more clearly illustrated in FIG. 6, that can accommodate the anchor material 16. Inclusion of the troughs 48 aid with controlling expansion of the interior wall 32 inwardly towards the axis A so there is sufficient space for the anchor material 16, while also creating a form for the anchor material 16 that results in longitudinal ridges on the dried, set or cured anchor material 16. These longitudinal ridges control possible lateral bending of the dried, set or cured anchor material 16 when a load is applied, such as when a load-bearing fixture is mounted to the anchor material 16. Additionally, the longitudinal ridges provide structural strength to the dried, set or cured anchor material while reducing the quantity of anchor material to form the anchor point or location.

The troughs 48 are illustrated as extending generally longitudinally, but it will be understood that the troughs 48 can extend longitudinally, circumferentially, helically, or modifications, or combinations therefore. Resultantly, the dried, set, or cured anchor material can have similarly situated grooves so the dried, set, or cured anchor material can have a fluted configuration.

Figure 2:
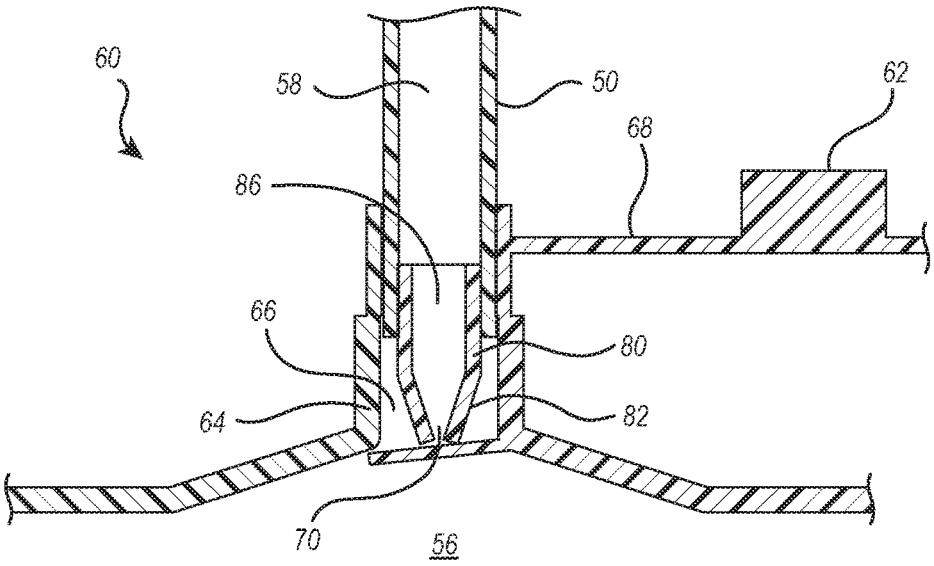
FIG. 2 illustrates a partial cross-sectional view of a portion of the expandable apparatus of FIG. 1 according to one embodiment of the present invention.
Figure 3:
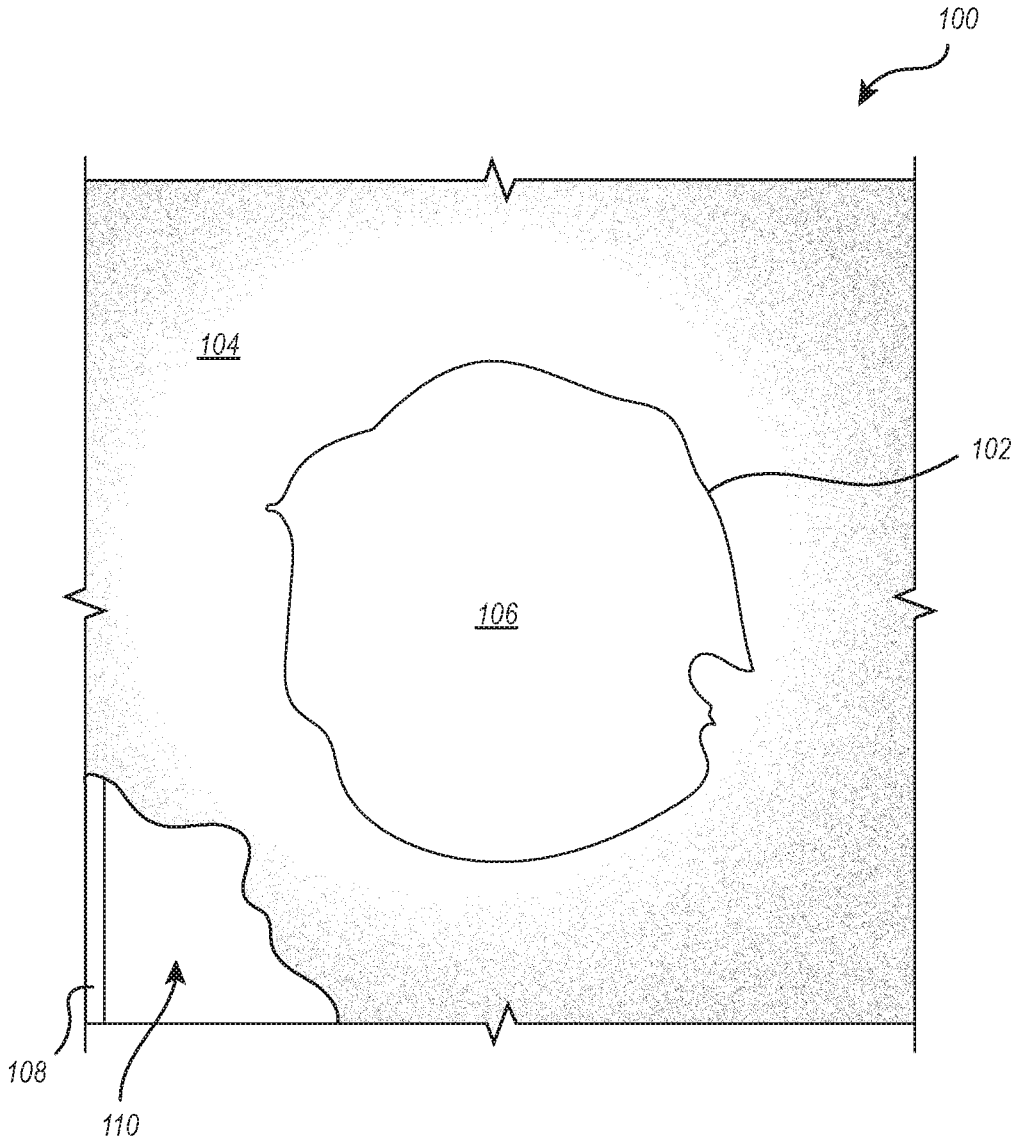
FIG. 3 illustrates a front perspective view of the expandable apparatus of FIG. 1 in a collapsed state inside a cavity of a hollow wall according to one embodiment of the present invention.

With continued reference to FIG. 1, an interior chamber 56 of the flexible body 12 is in selective fluid communication with the pump 14 via conduit 50 and a valve 60, as illustrated in FIGS. 1 and 2. Air is introduced into the interior chamber 56 using the pump 14 and an associated needle 80 or other attachment mechanism that connects the conduit 50 to the valve 60. The valve 60 can be a one-way valve that prevents immediate escape of air from the interior chamber 56, while a cover 62 prevents gradual release of the air from the valve 60. The cover 62, such as a stopper, plug, lid, cap, top, or other structure to close or seal the valve 60, can frictional engage with a valve stem or elongate body 64, whether exteriorly and/or interiorly within a bore 66 of the valve stem or elongate body 64, to prevent the cover 62 becoming detached from the valve 60. If a more secure attachment is desired, the bore 66 and/or an outer surface of the elongate body 64 and the cover 62 can include complementary threads to allow threaded engagement or other complementary mechanical connections that provide permanent or releasable engagement of the valve 60 and the cover 62.

The valve 60 is constructed so at least a portion can be pushed into the flexible body 22 so that it becomes recessed relative to an outer surface of the flexible body 22. For instance, at least a portion of the elongate body 64 has sufficient flexibility and/or a tapered construction so that it can be recessed on itself so that the cover 62 attached to the elongate body 64 is flush or recessed relative to the raised portion 46 or the front wall 26 to which is mounted. Alternatively, the valve 60 can be a military valve, an Achilles valve, a Halkey Roberts valve, a Leafield valve, a ball check valve, or another valve that is at least partially recessed relative to the raised portion 46, the front wall 26, or another portion of the outer surface of the flexible body 12.

As illustrated in FIG. 2, to allow air or other fluid to flow from the pump 14 to the interior chamber 56, the conduit 50 includes the needle 80 disposed within a bore 58 of the conduit 50 with a tapered end 82 extending away from an end of the conduit 50. The tapered orientation of the tapered end 82 allows the needle 80 to penetrate a diaphragm or flapper 70 of the valve 60. This allows an opening 84 of the needle 80 to be positioned within the interior chamber 56 of the flexible body 22. Air advanced along the bore 58 of the conduit 50 then passes through a bore 86 in fluid communication with both the opening 84 and the bore 66 to enter the interior chamber 56. The diaphragm or flapper 70 is positioned at an end of the elongate body 64 and has sufficient compliance, pliability or flexibility to seal against the needle 80 and prevent the air delivered through the bore 58 and the bore 86 to immediately escape from the interior chamber 56.

As illustrated in FIG. 2, the cover 60 is disposed on an arm 68 joined to the elongate body 64 of the valve 60. The valve 60, cover 62, and arm 68 can be formed as a single monolithic assembly fabricated from the same material, such as a polymeric material. This maintains the cover 62 and the valve 60 in close relationship and prevents inadvertent loss of the cover 62. Alternatively, the arm 68 and the cover 62 can be separate from the valve 60 and mounted or coupled to the valve 60.

Turning to FIG. 3-6, the manner by which the hole repair system and kit 10 of the present invention is used to repair a hole in a wall, such as the hole 102 in the wall 100. The hole 102 is formed in a wall panel 104 that is separated from a wall panel 106 by about 3-4 inches in a residential interior wall, with the cavity 110 being formed between the wall panel 104 and the wall panel 106 and studs 108 that maintain the separation of the wall panel 104 and the wall panel 106. Typically, the hole 102 is irregular because the wall panel 104 may be damaged when a weightbearing fixture is torn from the wall panel 104 and its mounts.

Figure 4:
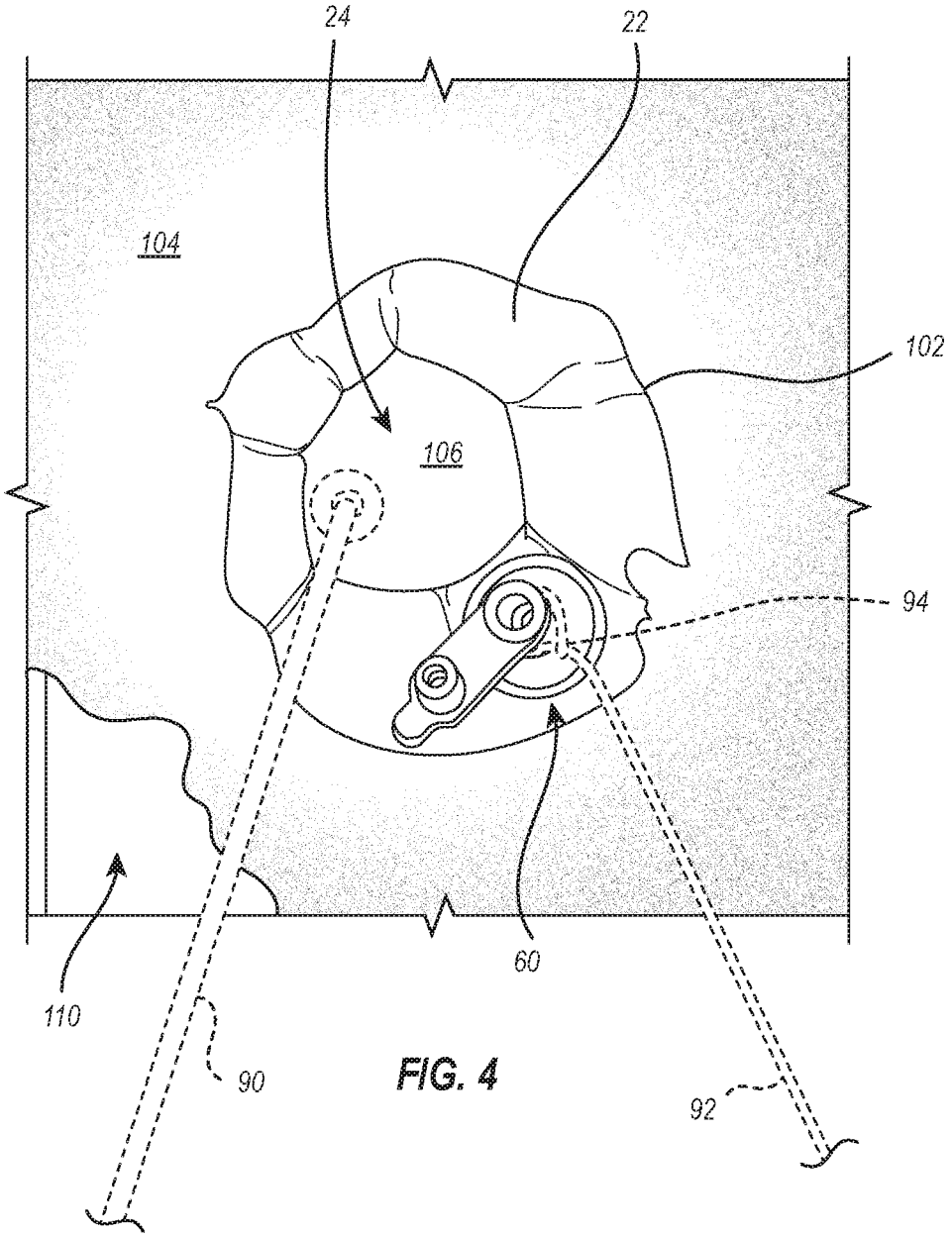
FIG. 4 illustrates a front perspective view of the expandable apparatus of FIG. 1 in an expanded state inside a cavity of a hollow wall according to one embodiment of the present invention.
Figure 5:
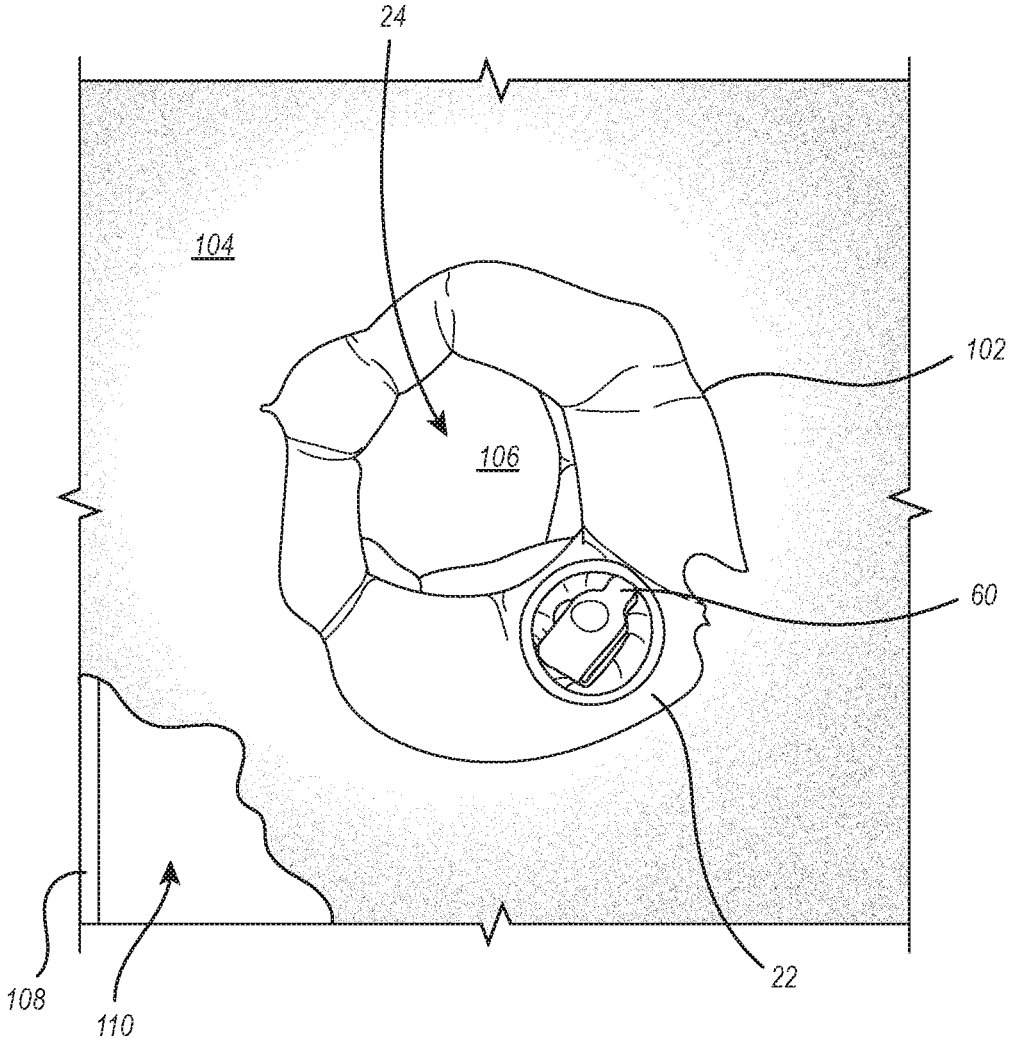
FIG. 5 illustrates a partial cross-sectional view of the expandable apparatus of FIG. 1 in an expanded state inside a cavity of a hollow wall according to one embodiment of the present invention.

As illustrated in FIG. 4, the expandable apparatus 12 is illustrated inserted through the hole 102 in a wall panel 104 to rest between the wall panel 104 and the wall panel 106 within the cavity 110. The valve 60 is open ready to receive the air or other fluid to inflate or expand the expandable apparatus 12 from the collapsed state of FIG. 4 to the inflated or expanded state of FIG. 5. Once inflated or expanded, the valve 60 is collapsible so that at least a portion of the valve 60 can be pushed into flexible body 22 and the cover 62 becomes flush or recessed relative to the outer surface of the expandable apparatus 12, such as the surface of the front wall 26 or the raised portion 46, as illustrated in FIG. 5. The placement of the valve 60 in the expandable apparatus 12 provides a smooth surface within which to place the anchor material 16 within the anchor receiving cavity 24. Consequently, this provides a surface to restore the uniformly smooth wall surface of the wall panel 104.

With continued reference to FIGS. 1, and 3-8, during use the expandable apparatus 12 is placed through the hole 102, such that the valve 60 is accessible through the hole 102. The pump 14 is used to begin to inflate the expandable apparatus 12 through the valve 60 and the conduit 50 (FIG. 1). As the expandable apparatus 12 is gradually inflated, it is held and positioned by a user's hand such that the anchor receiving cavity 24 of the expandable apparatus 12 remains generally at a center of the hole 102 in the wall panel 104. Alternatively, the user can use an elongate member 90 positioned through the anchor receiving cavity 24 as illustrated in FIG. 4. The elongate member 90, such as a rod or wood dowel can be placed through the anchor receiving cavity 24 to hold the expandable apparatus 12 in place during expanding. An end of the elongate member 90 can optionally include a suction cup or other structure to releasable attach the elongate member 90 to an interior surface 112 of the wall panel 106. In still another configuration, and optionally in tandem with the elongate member 90, a tether or retrieval string or member 92 can be attached to the valve 60 before inserting the expandable apparatus 12 into the cavity 110 in case the expandable apparatus 12 falls down in the cavity 110 so it is possible to retrieve the expandable apparatus 12 and reposition the expandable apparatus 12 before expanding. The tether 92 can be a string, cord, wire, line, cable, or modification, or combination thereof. The tether 92 can have a generally round or polygonal profile. The tether 92 can be tied to the valve 60 before or can include, or be formed to include, a loop or lasso 94 that can be secured to the valve 60. For instance, the loop 94 can be pre-formed slip loop or can and be formed by a user, such as forming a slip knot in a portion of the tether 92 and sliding the knot along a rail of the tether 92. Optionally, an end of the tether 92 can be anchored to the wall panel 104 or otherwise secured outside of the cavity 110.

Figure 6:
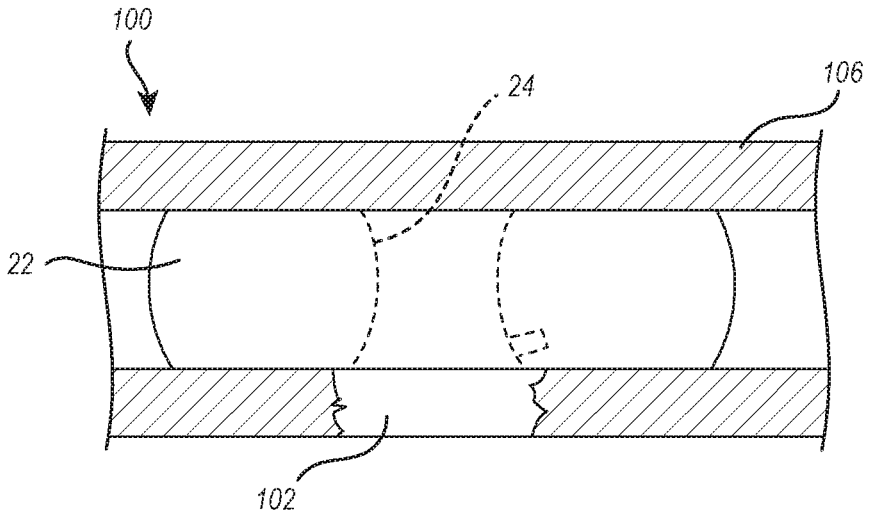
FIG. 6 illustrates a view of the expandable apparatus of FIG. 1 in an expanded state with the anchor material disposed over the expandable apparatus according to one embodiment of the present invention.

As the expandable apparatus 12 expands and transitions to the expanded state, it contacts both the wall panel 104 and the wall panel 106 of the wall cavity 110, as illustrated in FIG. 6, such that the expandable apparatus 12 becomes suspended between the wall panel 104 and the wall 108 of the wall cavity 110, once fully inflated.

As can be seen from FIG. 6, the anchor receiving cavity 24 has the generally hour-glass shape extending longitudinally between the wall panel 104 and the wall panel 106.

Following positioning the expandable apparatus, the needle 80 (FIG. 2) is removed from the valve 60 and the cover 62 is moved from the position illustrated in FIG. 4 in which the cover 62 remains open, to the position illustrated in FIG. 5 in which the cover 62 is mounted to the elongate body 64 of the valve 60 and the valve 60 is then collapsed into the expandable apparatus 12. The expandable apparatus 12 remains in the expanded state within the wall cavity 110 after the completion of the repair.

Figure 7:
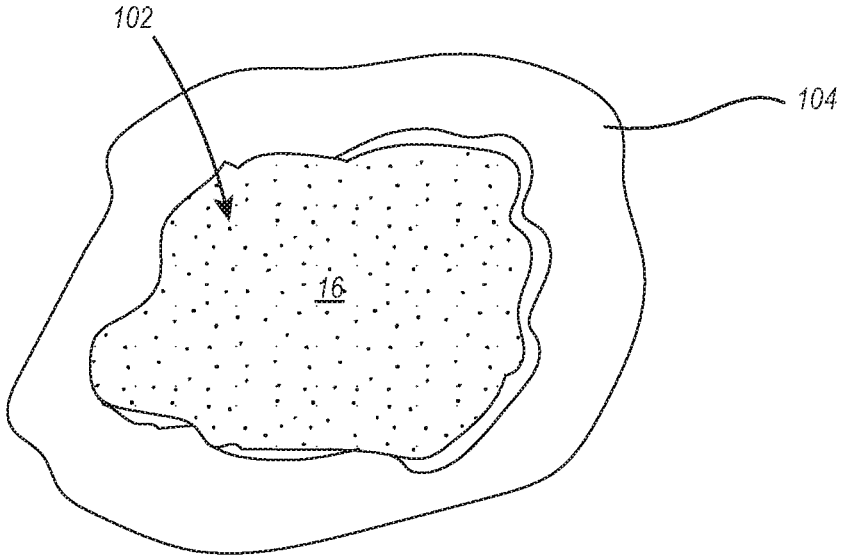
FIG. 7 illustrates a view of the expandable apparatus of FIG. 1 in an expanded state with the filler material disposed over the anchor material according to one embodiment of the present invention.

With the valve 60 retracted into the expandable apparatus 12 and below the wall surface 104, the elongate member 90 can be detached from the wall panel 106 and/or the tether 92 detached from the valve 60, such as by cutting or losing the loop or lasso 94, and the anchor receiving cavity 24 is filled with the anchor material 16 as illustrated in FIG. 7. The anchor material 16 fills the anchor receiving cavity 24 completely so it covers the portion of the expandable apparatus 12 visible through the hole 102, contacts the interior surface 112 of the wall panel 106, and at least partially fills the hole 102 of the wall panel 104, such as at least half-filled, between about 1/16 to about 1/4 inch below an outer surface of the wall panel 104, or some other depth as selected to accommodate the filler material 18 (optionally not filling any portion of the hole 102). By being in contact with the wall panel 106 and disposed within a part of the hole 102 when dried, set, or cured the anchor material 16 is limited in movement both longitudinally and transversely. Having a solid mass of anchor material between the wall panels 104 and 106 creates a more secure attachment, resulting in enhanced capabilities to withstanding longitudinal and torqueing movement from a load-bearing fixture supported by the anchor material 16.

The anchor material 16 can be a one-part or multi-part epoxy, such as a two-part epoxy or thermosetting polymer, optionally with a filler or binder. For instance, the anchor material 16 can include a resin and a hardener that when mixed together results in a chemical reaction that solidifies the resin. Alternatively, the anchor material 16 can be composed of cellulose material, such as wood dust, combined with a binder, and optionally a thinner and/or pigment. In still another configuration, the anchor material 16 can be any material having the desired dried, set, or cured physical properties to accommodate the loads and stresses associated with an attached load-bearing fixture. Examples include, but are not limited to, structural polyurethane foam, thermoset plastics, polyester, or modifications or combinations thereof.

Figure 8:
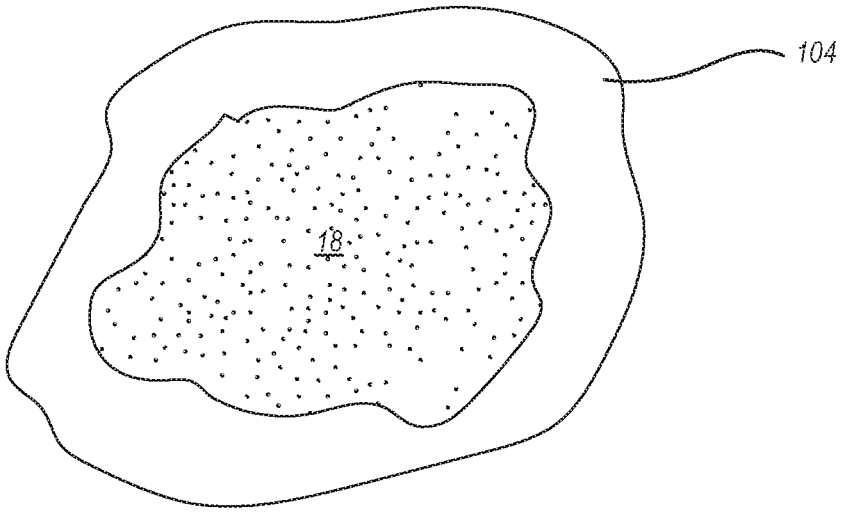
FIG. 8 illustrates another configuration of an expandable apparatus according to one embodiment of the present invention.

With continued reference to FIGS. 7 and 8, following filling the anchor receiving cavity 24, optionally the surround surface of the wall panel 104 can be cleaned of any anchor material 16 and then the anchor material 16 is allowed to dry, set or cure, such as according to a manufacturer's specifications, to form an anchor at the repaired area to which screws, nails or other types of fasteners may be affixed for the installation or reattachment of a door knob hole cover plate or weight-bearing fixtures, such as light fixtures, pictures, handrails or handles, towel fixtures and toilet paper fixtures, or other fixtures. Drying, setting, or curing can be usually from about 10-30 minutes, but can be shorter or longer based upon the particular composition of the anchor material.

To complete the repair of the hole 102, the filler material 18 is applied to the surface of the solidified anchor material 16 and extending over a portion of the wall panel 104, filling in the hole 102, as illustrated in FIG. 8. When the filler material 18 is dried, it can be sanded and then textured and/or painted to match the outer surface of the wall panel 104. Thereafter, a doorknob hole cover plate or weight-bearing fixture, such as a light fixture, picture, handrail or handle, towel fixture, toilet paper fixture, or other fixture can be attached or reattached at the repaired area. The filler material 18 can be a gypsum and water mixture, such as spackle or joint compound, optionally with a tint, adhesive or other additive, or some other material to fill the hole 102 and have similar mechanical properties to the material forming the wall panel 104.

Figure 9:
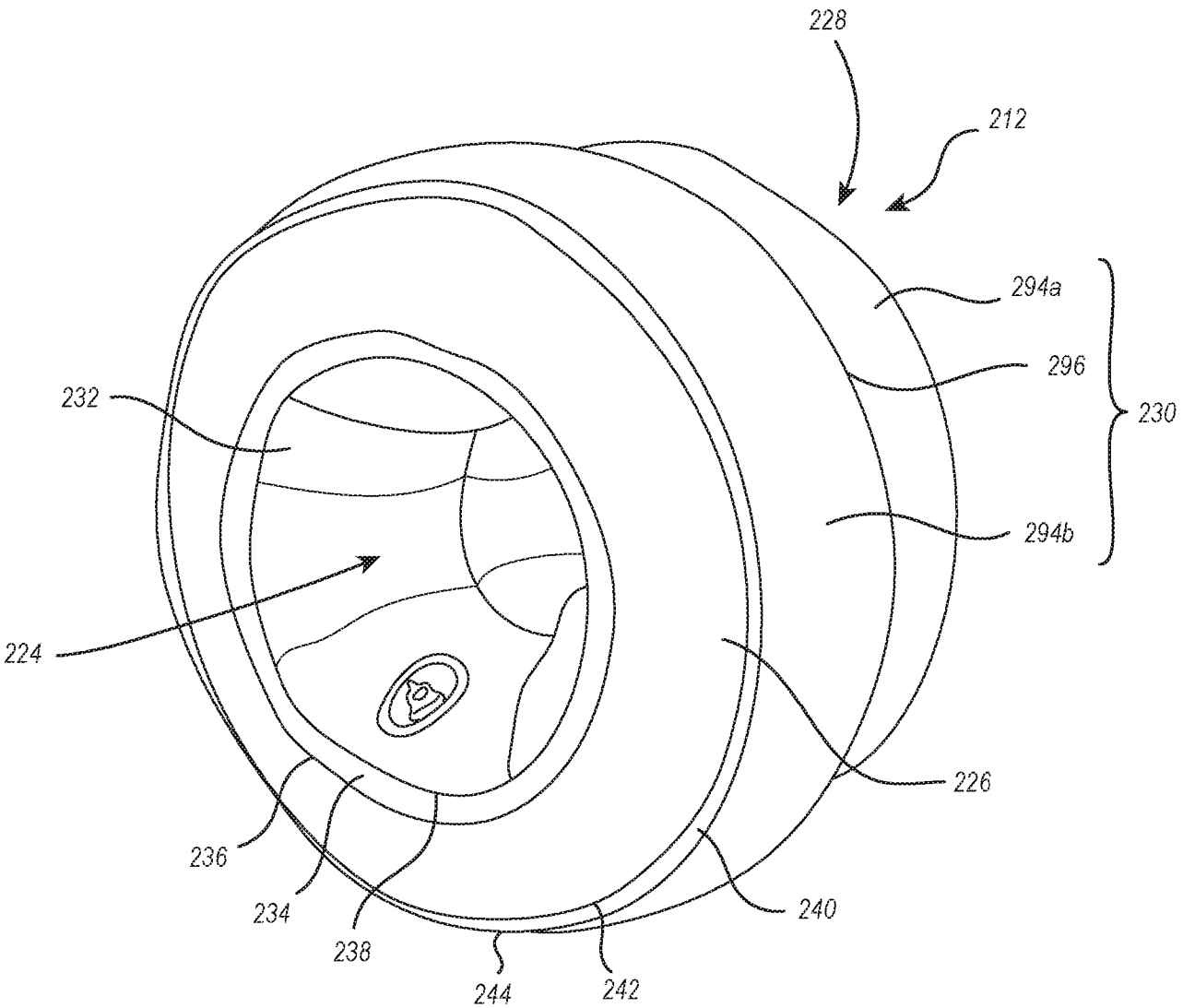
FIG. 9 illustrates another configuration of an expandable apparatus according to one embodiment of the present invention.
Figure 10:
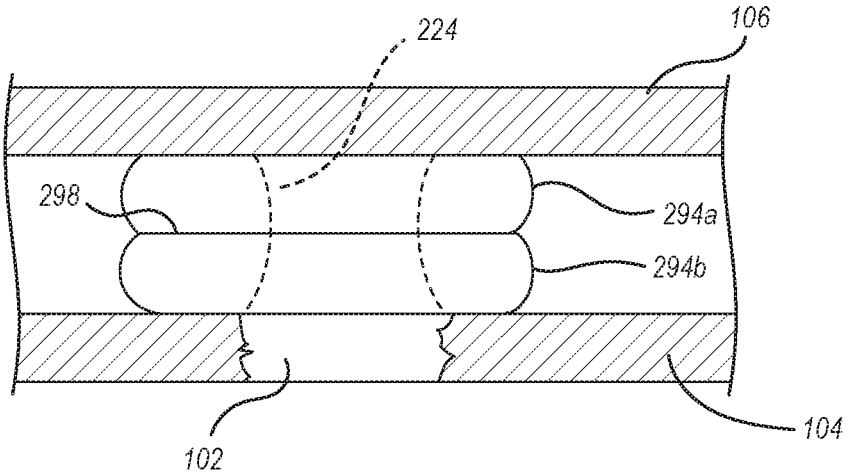
FIG. 10 illustrates a cross-sectional view of the expandable apparatus of FIG. 9 according to one embodiment of the present invention.

Turning to FIGS. 9 and 10 illustrated is another configuration of an expandable apparatus 212 that can form part of the hole repair system and kit 10. In this configuration, like structures are identified by like reference numerals and the discussion related to the configuration of FIGS. 1-8 is also applicable to the configuration of FIGS. 9-10. As illustrated, the expandable apparatus 212 includes a peripheral wall 230 separated into a first peripheral wall portion **294*a* and a second peripheral wall portion 294*b* with a circumferentially extending ridge region 296 between the first peripheral wall portion 294*a* and the second peripheral wall portion 294*b*. The ridge region 296 can be formed from multiple layers of material forming, respectively, the first peripheral wall portion 294*a* and the second peripheral wall portion 294*b*. For instance, the ridged region 296 can be formed by bonding, with or without the use of an adhesive, a portion of the first peripheral wall portion 294*a* and the second peripheral wall portion 294*b* to both seal them together and form a structural element that aids with controlling both radial and longitudinal expansion of the expandable apparatus 212. As with other ridge regions, the ridge region 296 can optionally include a self-expanding or resilient insert. Additionally, while reference is made to the ridge region 296 being circumferentially orientated, it can be understood that the peripheral wall and optionally the front wall, rear wall, and rings of the expandable apparatuses of the present invention can include ridge regions extending transversely to or longitudinally in a front to rear direction. For instance, and not by way of limitation to other location for formation of a ridge region on the flexible body of the expandable apparatuses described herein, a ridge region 298 can extend longitudinally rather than circumferentially over at least a portion of the peripheral wall as illustrated in FIG. 10 in phantom. The ridge region 298 can be in place of or in addition to the ridge region 296**.

While reference is made to the peripheral wall including the first peripheral wall portion and the second peripheral wall portion, it can be understood that an expandable apparatus can include two expandable apparatuses stacked generally along a longitudinal axis A and joined together to form a similar shape as the expandable apparatus. In such a case, the front wall of one expandable apparatus would be bonded, glued, or otherwise formed with the rear wall of another expandable apparatus and two valves would be used to expand the two apparatuses. Alternatively, a common wall can be formed between interior chambers of the two expandable apparatuses so that one wall forms an inner surface of two interior chambers of two expandable apparatuses.

Figure 11:
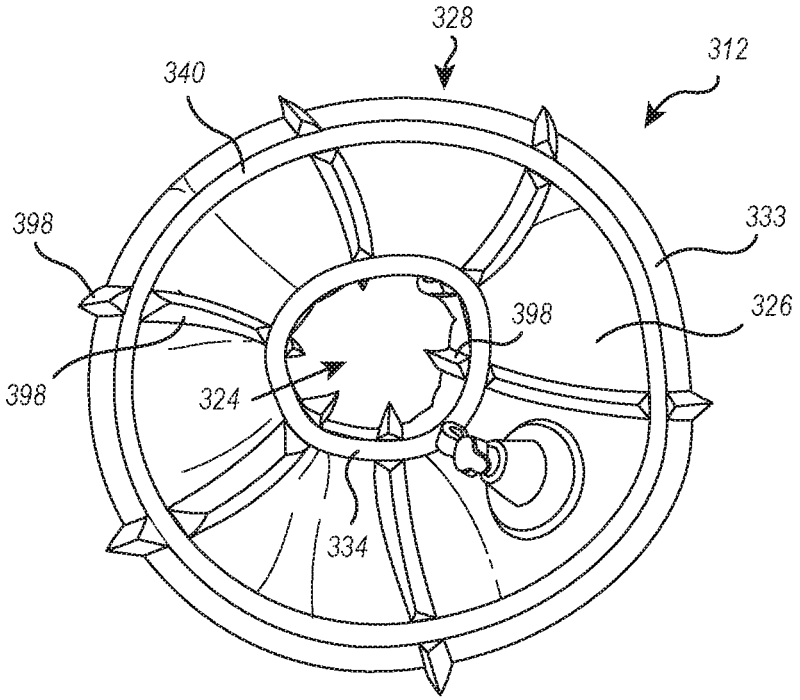
FIG. 11 illustrates a front view of another configuration of an expandable apparatus according to one embodiment of the present invention.

Turning to FIG. 11 illustrated is another configuration of an expandable apparatus 312 that can form part of the hole repair system and kit 10. In this configuration, like structures are identified by like reference numerals and the discussion related to the configuration of FIGS. 1-10 is also applicable to the configuration of FIG. 11. As illustrated, the guide apparatus 312 includes structures to increase friction engagement with the interior surfaces of the wall panels 104 and 106. Those structures also increase a surface area of the flexible body 322 thereby increasing a surface to which the anchor material can contact.

As illustrated in FIG. 11, portions of the flexible body 322 include one or more elongate ridge 398 that extend across one or more of the front wall 326, the rear wall 328, the peripheral wall 330, and the interior wall 332. The elongated ridges 398 taper upwardly way from the surface of the flexible body 322 and taper from end to end for a smoother transition to the rings 334 and 340. These ridges 398 can be formed from the same material as the front wall 326, the rear wall 328, the peripheral wall 330, and the interior wall 332 and extend away from the flexible body 322 when it is expanded or inflated. Alternatively, the ridges 398 can be hardened polymer or metal inserts that are glued, bonded or otherwise mounted or attached within a portion of an interior chamber and/or to the outer surface of the expandable apparatus 312. Additionally, although elongate ridges are illustrated, and are examples of structures to increase friction engagement with the interior surfaces of the wall panels 104 and 106 and/or the anchor material deposited within the anchor receiving cavity 324, more generally the flexible body 322 can include other structures such as, but not limited to, barbs, tines, ribs, protrusions, surface textures, or modifications, or combinations of the same, whether or not those structures are expandable, inflatable or substantially rigid members that are attached to the flexible body. Additionally, instead of including elongate ridges 398, the portions of the expandable apparatus disclosed herein can be covered or coated with an adhesive to aid with positioning and retaining the expandable apparatus within the cavity. This adhesive can be pre-formed on the outer surface of the expandable apparatus, such as on the front wall, rear wall, or other portion of the outer surface. This adhesive layer can include a release layer that can be removed during use, such as double-sided tape or similar adhesive layer, or can be an adhesive layer applied to the outer surface of the expandable apparatus as a liquid, film, or other manner.

Figure 12:
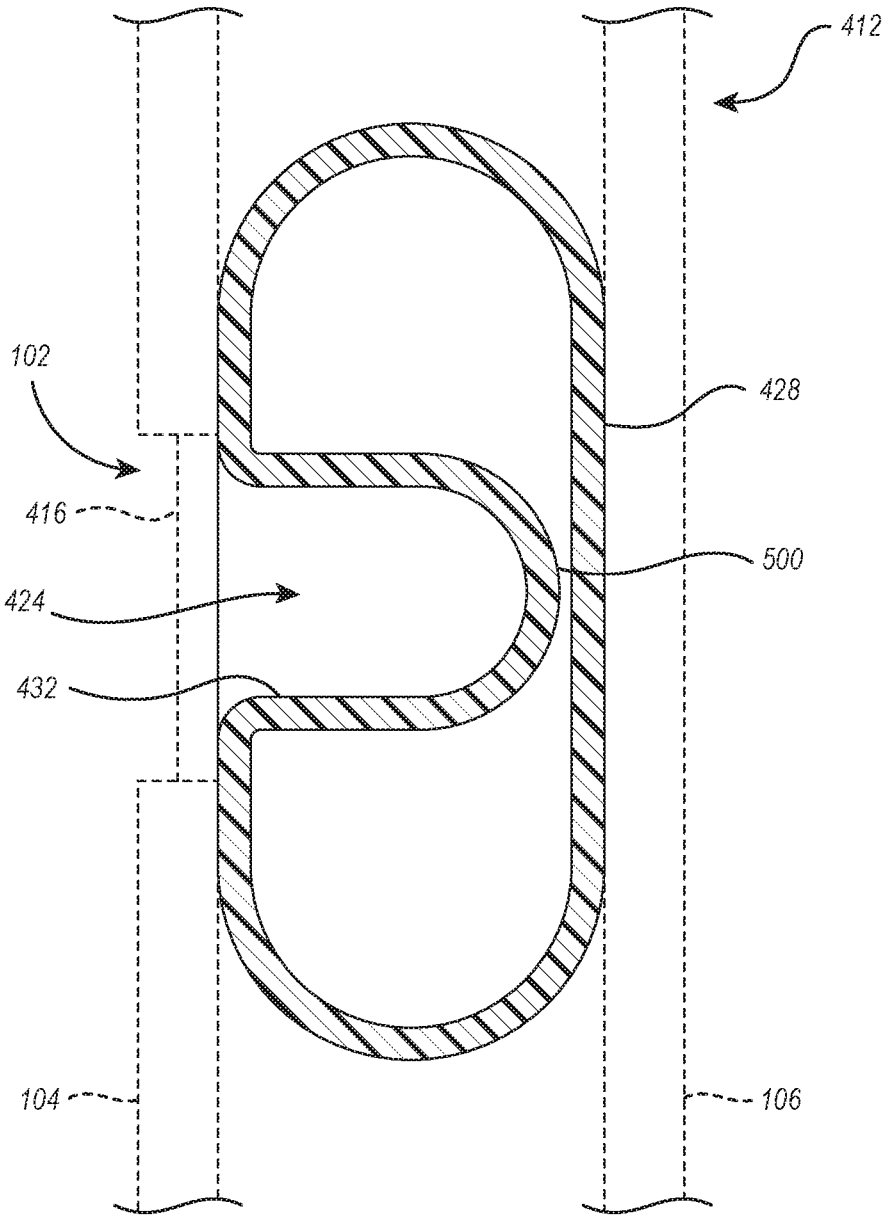
FIG. 12 illustrates a cross-sectional view of another configuration of an expandable apparatus according to one embodiment of the present invention.

Turning to FIG. 12 illustrated is another configuration of an expandable apparatus 412 that can form part of the hole repair system and kit 10. In this configuration, like structures are identified by like reference numerals and the discussion related to the configuration of FIGS. 1-11 is also applicable to the configuration of FIG. 12. As illustrated, the guide apparatus 412 includes a closed anchor receiving cavity 424 that terminates before a rear wall 428. An interior wall 432 has a bottom wall 500 extending across the anchor receiving cavity 424 to form a cup-shaped member to receive the anchor material. As with other configuration, the anchor materials 416 fills the anchor receiving cavity 424 and at least partially fills the hole 102 of the wall panel 104, but the anchor material 416 does not contact the wall panel 106. Instead, the bottom wall 500 can either be free to move relative to the wall panel 106 or can include one or more structures 502 to bite into, impale, or otherwise frictionally engage or fasten to the interior surface of the wall panel 106. For instance, the structures 502 can include barbs, tines, ribs, protrusions, surface textures, or modifications, or combinations of the same.

The described expandable apparatuses can be fabricated from a variety of material. For instance, the expandable apparatus can be fabricated from synthetic rubber, polymers, polyvinyl chloride, urethane, polyurethane, Neoprene, composite material, reinforced polymer, fiber-reinforced polymer, fiberglass, gas permeable material, laminated materials, and combinations of two or more thereof. A thickness of the materials forming the expandable apparatus can be about 5 mil to about 35 mil, about 8 mil to about 25 mil, about 10 mil to about 20 mil, and about 10 mil to about 15 mil. The thickness of the materials larger and smaller may also be permissible and may be based on the size of the repair or the like.

Generally, the flexible bodies described herein can have an outside diameter of about 2 inches to about 12 inches, about 3 inches to about 9 inches, about 4 inches to about 8 inches, or about 5 inches. Additionally, the interior or anchor receiving cavity 24 can have a diameter near the front or rear walls of about 2 inches to about 12 inches, about 3 inches to about 9 inches, about 4 inches to about 8 inches, or about 4 inches. Additionally, the interior or anchor receiving cavity 24 can have a diameter near a tapered center of about 2 inches to about 12 inches, about 3 inches to about 9 inches, about 4 inches to about 8 inches, or about 2.25 inches. Additionally, an overall length of the expandable apparatus, such as from the front wall to rear wall, is about 1 to about 12 inches, about 2 inches to about 10 inches, about 2 inches to about 7 inches, about 2 inches to about 5 inches, about 2 inches to about 3 inches, and about 3.875 inches. The diameters of the flexible body and the anchor receiving cavity, and the length and shape of the expandable apparatus can be changed if desired.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant work of drywall repair.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A kit for repairing an opening in a wall, the kit comprising:

an expandable apparatus comprising a flexible body with at least one chamber and a valve, the flexible body being inflatable and comprising a front wall and a rear wall and forming an anchor receiving cavity extending entirely through the flexible body of the expandable apparatus from the front wall to the rear wall;

an anchoring material configured to be disposed within the anchor receiving cavity; and a filler material configured to be disposed on the anchoring material and fill the opening to repair the opening in the wall.

2. The kit of claim 1, further comprising a pump configured to selectively couple to the valve of the expandable anchor and guide.

3. The kit of claim 2, wherein the valve is a one-way valve.

4. The kit of claim 2, wherein the valve is selectively retractable.

5. The kit of claim 2, wherein the valve is selectively collapsible to become recessed or flush with a surface of the flexible body.

6. The kit of claim 1, wherein the valve comprises a valve stem mounted to a flexible body, a flexible junction between the valve stem and the flexible body being configured to allow the valve stem to extend outwardly from the surface of the flexible body during filling of the inflatable anchor and guide apparatus and a collapsible to become flush with the surface of the flexible body following filling.

7. The kit of claim 1, wherein the anchor materials comprises a one-part or multi-part epoxy.

8. The kit of claim 1, wherein the filler material comprises a gypsum and water mixture.

9. A kit for repairing an opening in a wall, the kit comprising:

an expandable apparatus comprising a flexible body with at least one chamber and a valve, the flexible body being inflatable and comprising a front wall and a rear wall and forming an anchor receiving cavity extending entirely through the flexible body of the expandable apparatus from the front wall to the rear wall;

an anchoring material configured to be disposed within the anchor receiving cavity; and a filler material configured to be disposed on the anchoring material and fill the opening to repair the opening in the wall and form a repaired area that can support attachment of a weight bearing fixture.

* * * * *